United States Patent [19]

Baretz et al.

[11] Patent Number: 4,771,724

[45] Date of Patent: Sep. 20, 1988

[54] REMOTE ACTIVATION OF A CHEMILUMINESCENT LIGHTSTICK

[75] Inventors: Bruce H. Baretz, Passaic; C. Dexter Ware, Bergen, both of N.J.

[73] Assignee: American Cyanamid Company, Stamford, Conn.

[21] Appl. No.: 63,380

[22] Filed: Jun. 18, 1987

[51] Int. Cl.[4] ..... F21K 2/06; G08B 13/12

[52] U.S. Cl. ..... 116/202; 116/7; 116/81; 367/34

[58] Field of Search ..... 362/34, 84; 116/7, 81, 116/88, 202, 165, DIG. 35; 102/429, 428, 422, 423

[56] References Cited

U.S. PATENT DOCUMENTS

| | | | |
|---|---|---|---|
| 988,026 | 3/1911 | Poinsett | 116/88 |
| 1,054,448 | 2/1913 | Ricker | 116/88 |
| 1,479,184 | 1/1924 | Keeler | 116/81 |
| 3,539,794 | 11/1970 | Rauhut et al. | 362/34 |
| 3,752,406 | 6/1973 | McDermott et al. | 362/34 |
| 3,829,678 | 8/1974 | Holcombe | 362/34 |
| 3,844,248 | 10/1974 | Parker | 362/34 |
| 3,900,728 | 8/1975 | Holcombe | 362/34 |
| 3,940,604 | 2/1976 | Rauhut | 362/34 |
| 4,186,426 | 1/1980 | Ginegras, Sr. et al. | 362/34 |

FOREIGN PATENT DOCUMENTS

| | | | |
|---|---|---|---|
| 354681 | 6/1922 | Fed. Rep. of Germany | 116/88 |
| 363686 | 11/1922 | Fed. Rep. of Germany | 116/88 |
| 800044 | 7/1949 | Fed. Rep. of Germany | 116/81 |
| 389 | of 1856 | United Kingdom | 116/165 |

*Primary Examiner*—Samuel Scott
*Assistant Examiner*—Carl D. Price
*Attorney, Agent, or Firm*—Frank M. Van Riet

[57] ABSTRACT

A non-pyrotechnic lighting device is disclosed whereby intrusion into a restricted area can be monitored and detected by the use thereof. Triggering of the device is effected remotely by the unsuspecting subject.

6 Claims, 3 Drawing Sheets

REMOTE ACTIVATION OF A CHEMILUMINESCENT LIGHTSTICK

BACKGROUND OF THE INVENTION

This invention relates to a device for providing a means of securing an area from unwanted intrusion. The device more particularly enables the detection of an unwanted intruder at a place somewhat remote from the actual point of entry into the restricted area. The device not only warns the one monitoring the area that an intrusion has occurred, but illuminates the area around the device so that if the intrusion is proximate to the device, the intruder is visible.

DESCRIPTION OF THE PRIOR ART

Many different detection devices have been devised which will signal and/or detect an unwanted intrusion into a restricted area. These devices, although oftimes highly successful both commercially and in use, may suffer from certain deficiencies, such as for example, the need for an electric current, either direct or battery sourced. Additionally, some devices which are not electricity dependent, have been known to cause inflammation of the surrounding area when activated, such as, for example, a detonation device which may be triggered by mechanical activation. Thus, a useful detection device which is not electricity dependent and is non-pyrotechnic when activated would provide a step forward in the art.

SUMMARY OF THE INVENTION

Illumination, as is well known, can be effected by chemical as well as electrical systems. Such chemical illumination is provided solely as a result of a chemical reaction and is known as chemiluminescent light. Such light requires no externally generated source of energy and thus, sources thereof can be made small and portable. It can be used outdoors even in areas of high moisture because water does not substantially interfer with the chemical reaction which occurs.

The instant invention provides a non-pyrotechnic lighting device capable of remote activation. The device, when positioned strategically, enables the securing of a restricted area by either military or civilian personnel, so as to prevent, or at least detect, an unwanted intrusion of a subject into said area. The device combines the advantages of chemiluminescent light and remote activation so as to provide a signal of an intrusion, the illumination of the intruder and sufficient time to request assistance against, or to prepare to resist, said intruder.

THE DRAWINGS

Figure 1:
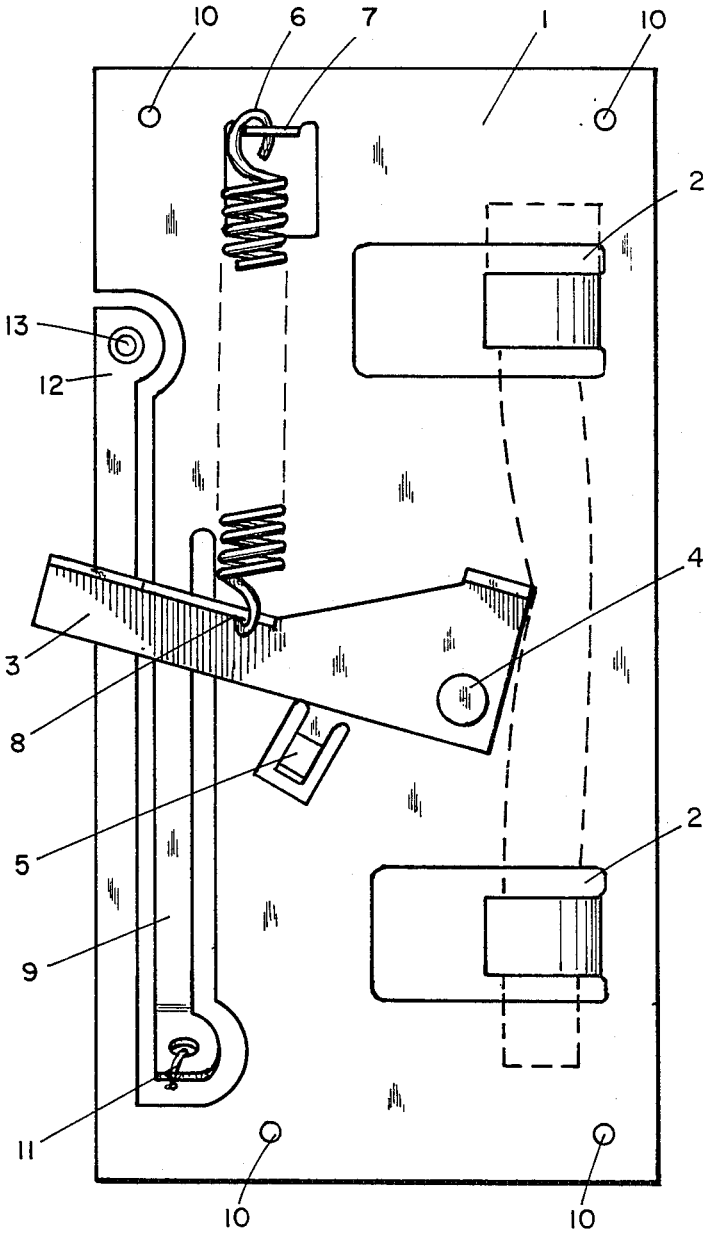

FIG. 1 comprises a front view of the device showing the lever in unlocked position.

Figure 2:
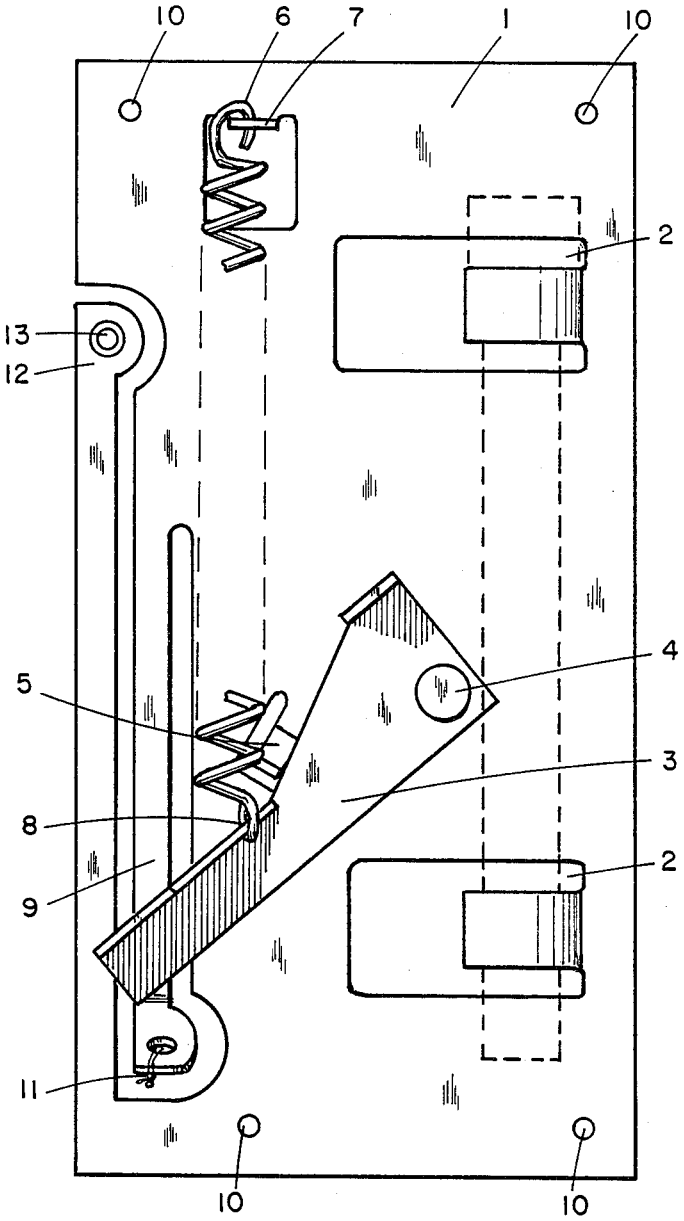

FIG. 2 comprises a front view of the device showing the lever in locked position.

Figure 3:
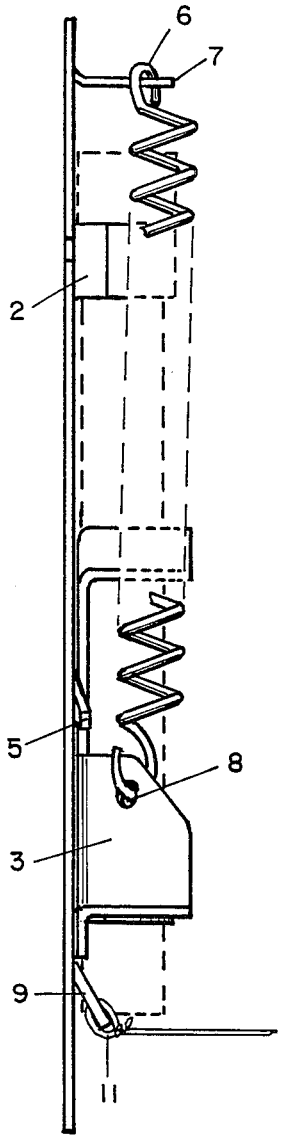

FIG. 3 comprises a side view of the device with the lever in locked position.

Figure 4:
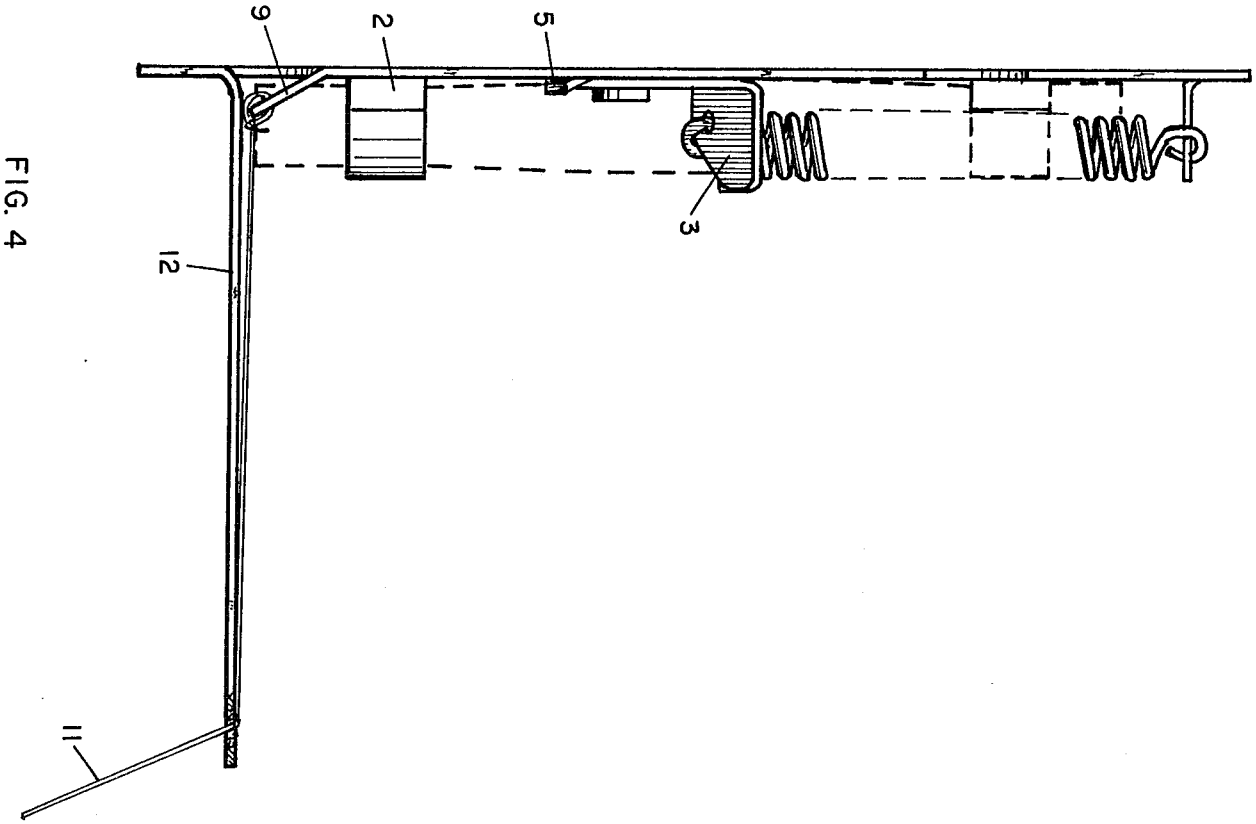

FIG. 4 comprises a side view of the device with the lever in unlocked position and the cord direction diverter in position for use.

DESCRIPTION OF THE INVENTION INCLUDING PREFERRED EMBODIMENTS

The invention resides in a non-pyrotechnic device capable of remote activation comprising;

(a) a plate;

(b) attaching means for mounting a chemiluminescent lightstick to said plate;

(c) a lever means rotatably mounted on said plate and positioned such that at least a portion of said lever, in its unlocked position, lies within the stationary, longitudinal plane of a lightstick mounted to said plate by said attaching means;

(d) locking means on said plate to maintain said lever, when locked, out of said stationary plane of said mounted lightstick;

(e) tension means attached to said plate and said lever to cause said lever to forcibly resist retention by said locking means, and (f) release means for remotely unlocking said lever from said locking means.

In a preferred embodiment, the device also includes;

(g) means in said plate for the mounting of said plate on a substrate, and may also include, (h) an adjustable cord direction diverter adapted to receive a cord attached to said release means and enable angular remote activation of said device.

The chemical lightsticks useful in the device of the present invention are well known to those skilled in the art. Thus, detailed explanations and descriptions of such articles are not necessary. Suffice it to say, they generally comprise an elongated thin-walled glass tube, sealed at each end and contained within a sealed transparent plastic tube. The glass tube is filled with one component of a two component chemiluminescent system and the plastic tube contains the second component. The formation of chemical light is effected by bending the lightstick thereby breaking the glass tube and allowing its contents to mix with the contents of the plastic tube. Any of such articles may be used in the device of the present invention including those containing a plurality of glass inner tubes. Reference to U.S. Pat. Nos. 3539794; 3752406; 3940604 and 4186426 is hereby made for purposes of providing exemplary illustration of articles useful in this invention, which patents are hereby incorporated herein by reference.

The present invention may be better understood by reference to the accompanying drawings which have previously been briefly described. Specifically referring to FIG. 1, there is provided a non-pyrotechnic lighting device capable of remote activation wherein plate 1 has thereon attaching means 2 for mounting a chemiluminescent lightstick thereon, said mounted lightstick being shown by dotted lines. Lever means 3 is rotatably mounted on said plate 1 via fulcrum 4 and is positioned on plate 1 so that at least a portion thereof, when in its unlocked position, lies within the stationary, longitudinal plane of the lightstick held by attaching means 2.

Locking means 5 comprising a restraining elevation which maintains lever 3, when in its locked position, out of said stationary longitudinal plane of said lightstick. Means 5, best seen in FIG. 3, may constitute a raised section of plate 1 or can comprise any equivalent means such as an appended, beveled projection. Tension means, shown as spring 6, attached to plate 1 at point 7 and lever 3 at point 8, causes lever 3 to forcibly resist retention by locking means 5, as best shown in FIG. 2. Release means 9 comprises an elongated, flexible section of plate 1 from which most of the surrounding area of plate material has been removed.

Holes 10 provide means for mounting the device on a substrate such as a tree, fence post, etc. via a nail, screw or other securing means.

A length of tough cord or wire, etc. is affixed to the end of release means 9.

In operation, lever 3 is locked by locking means 5 and an unactivated chemiluminescent lightstick is mounted via means 2. The device, previously having been attached to a substrate, is activated by an intruder whose person comes into contact with cord or wire 11, which has been stretched across the terrain to be secured from intrusion. The cord causes release means 9 to bend or flex thereby forcibly tripping lever 3 out of its locked position. The potential energy from extended spring 6 is transferred into rotational kinetic energy of the fulcrum and lever 3 forcibly contacts the lightstick, breaking the inner tube and causing light, thereby identifying the area of intrusion.

Adjustable cord direction diverter 12, shown fully extended at 90° from plate 1 in FIG. 4, also comprises an elongated, flexible section of plate 1 from which the surrounding area of plate material is removed. It is preferably positioned parallel to release means 9 in order to enable cord 11 to cooperatively function therewith. Diverter 12 can be bent from 1°–180° from the plane of plate 1 with cord 11 being threaded through hole 13 which preferably has a smooth interior to allow movement of cord 11 without fraying. Diverter 12 allows cord 11 to activate the device by unlocking lever 3 by an intruder at varying longitudinal or latitudinal angles from the front plane of plate 1.

We claim:

1. A device for activation of a chemiluminescent lightstick cable of remote activation comprising:

a. plate;

b. attaching means on said plate for mounting a chemiluminescent lightstick to said plate such that when a lightstick is mounted to said plate between portions of said attaching means it lies in a longitudinal plane defined by said portions;

c. lever means rotatably mounted to and positioned on said plate to move between a locked position and an unlocked position, at least a portion of said lever, when, in said unlocked position, lying within said longitudinal plane, and being arranged to rotate to a position intersecting said longitudinal plane occupied by said lightstick to cause the lightstick to be deflected and thereby result in activation of the lightstick;

d. locking means on said plate to maintain said lever, when in said locked position, out of said stationary plane of said mounted lightstick;

e. tension means attached to said plate and said lever to cause said lever to forcibly resist retention by said locking means, and;

f. release means for remotely unlocking said lever from said locking means.

2. A device according to claim 1 including, g. means in said plate for mounting said plate on a substrate.

3. A device according to claim 1, wherein said release means includes a length of tough cord.

4. A device according to claim 1, including, h. an adjustable cord direction diverter adapted to receive a cord attached to said release means and to enable angular remote activation of said device.

5. A device according to claim 2 wherein said release means includes a length of tough cord.

6. A device according to claim 4 wherein said release means includes a length of tough cord.

* * * * *